United States Patent [19]

Thoe

[11] Patent Number: 4,467,388

[45] Date of Patent: Aug. 21, 1984

[54] ELECTROMAGNETIC CHUCK POWER SUPPLY AND CONTROLLER

[75] Inventor: James H. Thoe, Alma, Mich.

[73] Assignee: Hitachi Metals International Ltd., White Plains, N.Y.

[21] Appl. No.: 395,108

[22] Filed: Jul. 6, 1982

[51] Int. Cl.[3] ..... H01F 13/00

[52] U.S. Cl. ..... 361/145; 335/289; 361/204

[58] Field of Search ..... 361/143, 144, 145, 149, 361/204; 335/289, 290

[56] References Cited

U.S. PATENT DOCUMENTS

| | | | |
|---|---|---|---|
| 3,034,021 | 5/1962 | Callihan | 361/143 |
| 3,187,155 | 6/1965 | Becbert et al. | 361/149 X |
| 4,306,269 | 12/1981 | Bocchiere et al. | 361/149 |
| 4,402,032 | 8/1983 | Wilterdink | 361/145 |

*Primary Examiner*—Harry E. Moose, Jr.
*Attorney, Agent, or Firm*—Hauke & Patalidis

[57] ABSTRACT

An electromagnetic chuck power supply and control comprising a magnetic amplifier consisting of a saturable reactor supplying DC power at its output across the electromagnet coils of the electromagnetic chuck. A controllably variable DC current is supplied across the control winding of the magnetic amplifier such that the DC power at the output of the magnetic amplifier is inversely proportional to the DC current flow through the control winding. Variable workpiece holding power is thus obtained at the electromagnetic chuck. At full control current flow, the electromagnetic chuck has no holding power except that due to the residual magnetization of the workpiece. In the event of complete failure of the control current circuit, maximum holding force is applied by the chuck to the workpiece. Automatic de-magnetization of the workpiece is provided by applying a gradually increasing DC voltage across the control winding of the magnetic amplifier and sequentially reversing the current flow at the output of the magnetic amplifier such as to supply alternative current pulses of progressively decreasing amplitude to the chuck electromagnet coils.

15 Claims, 4 Drawing Figures

ELECTROMAGNETIC CHUCK POWER SUPPLY AND CONTROLLER

BACKGROUND OF THE INVENTION

The present invention relates to electromagnetic chucks in general and more particularly to an electromagnetic chuck power supply and controller.

Electromagnetic chucks are used on various machine tools such as, for example, milling machines, drill presses, lathes and surface grinders for holding a workpiece in position while a machining operation is effected upon the workpiece. Electromagnetic chucks comprise one or a plurality of electrical coils inducing magnetic flux lines in electromagnet cores made of a ferromagnetic material such as low carbon, high permeable steel or cast iron. The electrical coils are wound in such direction and the holding surfaces of the diverse electromagnets are arranged such that areas of opposite magnetic polarities are engaged by the workpiece, with the result that the workpiece, also made of ferromagnetic material, is held on the surface of the electromagnet cores.

When it is desired to release the workpiece, the chuck coils are de-energized, such as to permit the removal of the workpiece from engagement with the chuck surface. However, as the workpiece is made of ferromagnetic material, generally steel, it becomes magnetized to a certain degree and the residual magnetism of the workpiece may be such as to make it difficult to remove the workpiece from the chuck surface, unless the workpiece is, at least partially, de-magnetized.

As the coils of electromagnetic chucks are energized with direct current, a source of direct current is thus required. The direct current is generally obtained from an AC/DC converter, through rectification to direct current of the alternating current generally obtainable from the mains. Conversion of alternating current to direct current is achieved by way of vacuum tubes, diode rectifier bridges, and the like. De-magnetization of the workpiece is achieved by reversing the direction of flow of the direct current in the chuck coils, such as to knock down the residual magnetism in the workpiece. De-magnetization of the workpiece may be accomplished manually by operating a reversing switch, and applying direct current, generally at a reduced voltage, across the chuck coils for a short period of time, of the order of a few seconds or less, for example. However, with large workpieces, the holding force from residual magnetism may be so great as to prevent removal of the workpiece with a single one-step demagnetization pulse. In order to accomplish full demagnetization of the workpiece, a series of alternating pulses of progressively decreasing amplitude is required.

Adjustably variable holding force is a desirable convenient feature in an electromagnetic chuck. It permits the use to controllably adjust the DC voltage or current to the chuck such that the magnetic flux and, consequently, the holding force may be controllably adjusted. Such a feature is convenient if it is desired to maintain a holding force sufficient to hold a workpiece on the chuck during machining of the workpiece, but not so strong as to cause shape deformation of the workpiece. In conventional electromagnetic chucks, variable holding power is accomplished for example by using variable or multiple dropping resistors, or multi-tapped transformers, or by using phase angle fired silicon rectifiers. However, the use of resistors or multi-tap transformers requires mechanical devices such as rotary switches manually operated or operated by stepping motors. The use of phase angle fired SCR to vary the power applied to the electromagnetic chuck is subject to fairly erratic performance from surges or variations in the AC line voltage. Failure of an SCR eliminates power to the chuck, with the resulting safety hazard of complete loss of workpiece holding force, or reduction of the holding force to that caused by residual magnetization.

The present invention provides a controllable power supply for electromagnetic chucks which, through the use of a magnetic amplifier controlled by a DC current flowing in the control winding of a saturable reactor magnetic amplifier, permits to adjustably vary the power supplied to the load circuit, the electromagnetic chuck coils, from zero to 100% by varying the intensity of the DC control current flowing through the control winding of the magnetic amplifier. In addition, in the event of failure of the DC control circuit, full output power is applied to the electromagnetic chuck coils, as the load power delivered at the output of the magnetic amplifier is inversely proportional to the control current intensity. Furthermore, the present invention provides automatic de-magnetization of the workpiece held by an electromagnetic chuck in applications where such a feature is desirable to facilitate removal of the workpiece from the chuck.

SUMMARY OF THE INVENTION

The principal object of the present invention is to provide a novel electromagnetic chuck power supply and control having the advantages of enabling the use to controllably use full holding power, variable holding power, no holding power, except that due to residual magnetism for removal of the workpiece, and automatic de-magnetization of the workpiece.

These and other objects and advantages of the present invention will become apparent to those skilled in the art when the following description of the best mode contemplated for practicing the invention is read in conjunction with the accompanying drawing wherein:

DETAILED DESCRIPTION OF THE PREFERRED EMBODIMENT

Figure 1:
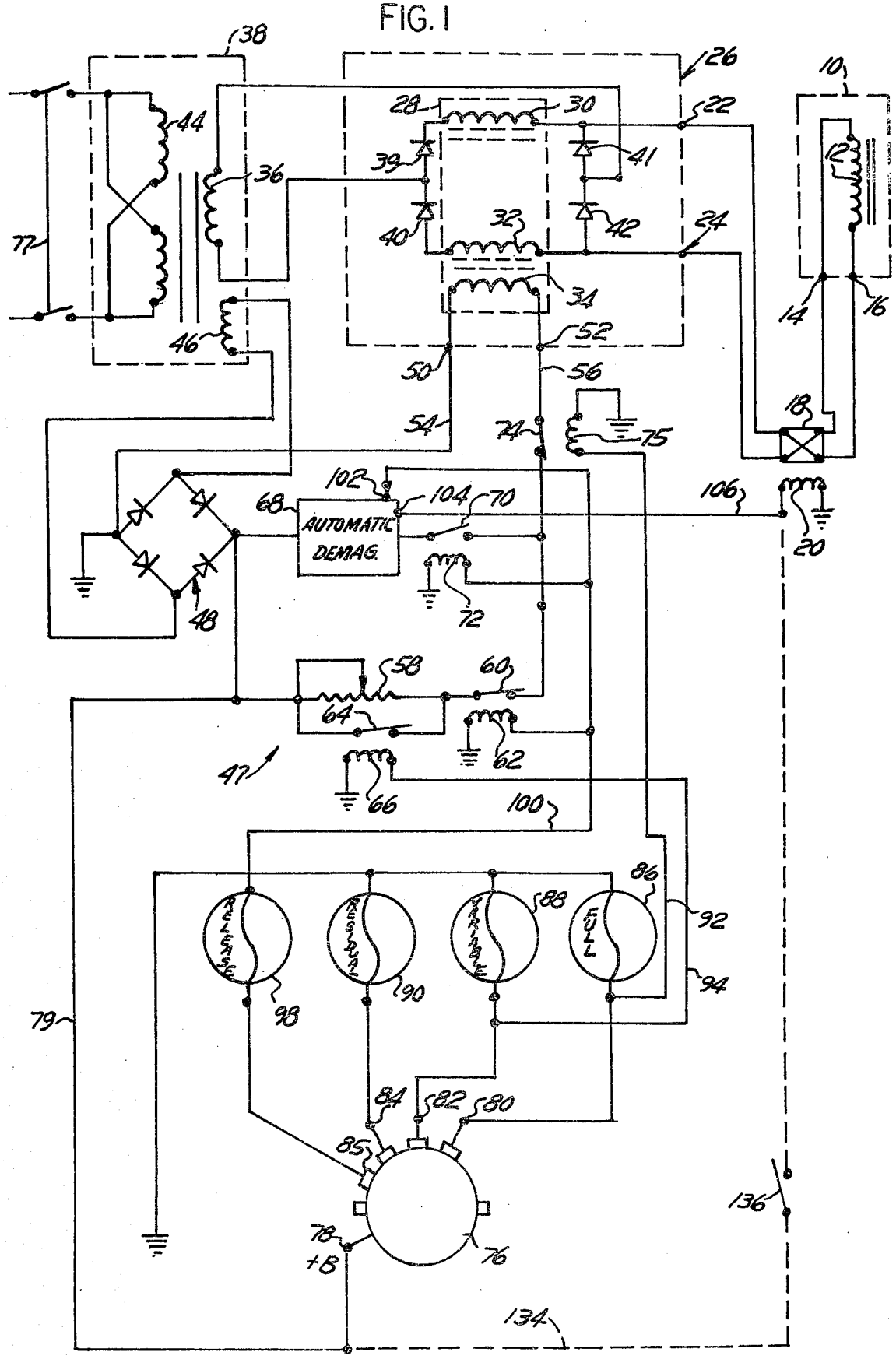
FIG. 1 is a simplified wiring diagram of a controllable power supply for an electromagnetic chuck.

Referring now to the drawing and more particularly to FIG. 1, the magnetic chuck 10 of a machine tool, such as a surface grinder for example, is provided with electromagnet coils 12 having a source of DC electrical current connected across its inputs 14 and 16 through a reversing relay switch 18 operable by a solenoid 20. The input of the reversing relay switch 18 is connected to the output terminals 22 and 24 of a magnetic amplifier 26.

The magnetic amplifier 26 comprises a saturable reactor 28 having a pair of power windings 30 and 32 and a DC control winding 34. The power windings 30 and 32 of the saturable reactor 28 are connected across a first secondary winding 36 of a power transformer 38 via a full-wave rectifier bridge comprising diodes 39, 40, 41 and 42, such as to provide DC current across the output terminals 22 and 24 of the magnetic amplifier 26. The power transformer 38 has a primary winding 44 connected across a source of alternating current, and a second secondary winding 46 providing a relatively low voltage DC current through the magnetic amplifier control circuit 47, after rectification through a full-wave rectifier bridge 48 connected across the input terminals 50 and 52 of the control windings 34 through respectively lines 54 and 56. A control potentiometer 58 is connected in the control circuit 47 of the control winding 34 through a normally closed relay switch 60 operable to an open position by a solenoid 62. A normally closed relay switch 64 shunts the potentiometer 58. The relay switch 64 is operable to an open position by a solenoid 66.

A workpiece automatic de-magnetization unit 68 is connected in parallel to the series circuit formed by the control potentiometer 58 and the relay switch 60. A normally open relay switch 70, operable by a solenoid 72, controllably places the workpiece automatic de-magnetization unit 68 in the control circuit.

A forth normally closed relay switch 74, operable to an open position by energizing a solenoid 75, is connected in series in the DC control circuit 47 in the line 56, as shown, or, alternatively in the line 54, such as to controllably open the control circuit 47, irrespective of whether current flows through the circuit branch including the automatic de-magnetization unit 68 or the circuit branch including the potentiometer 58.

The electromagnetic chuck 10 is operated from a control panel placed at the disposal of the operator of the machine tool on which the electromagnetic chuck 10 is installed. The control panel, not shown, has an on-off switch for operating the main relay switch 77 connecting or disconnecting the primary winding 44 of the power transformer 38 across a source of alternating current, and a rotary switch 76 for manually controlling the modes of operation of the electromagnetic chuck.

A common terminal 78 of the rotary switch 76 is connected through a line 79 to the relatively low +B DC voltage at the output of the rectifier bridge 48. The rotary switch 76 has at least four function terminals 80, 82, 84 and 85 for the operation modes of the electromagnetic chuck 10, which, simultaneously with controlling the functional mode, energize one of the function indicator lights 86, 88, 90 or 98.

When the indicator light 86 is on as a result of the rotary switch 76 being operated to place the terminal 80 at the +B voltage, "full" power is delivered to the electromagnetic chuck from the output terminals 22–24 of the magnetic amplifier 26. Such a function is accomplished as a result of the solenoid 75 being energized through a line 92 such as to open the control circuit shut-off relay switch 74, thus opening the DC current control circuit 47 of the magnetic amplifier control winding 34. As no DC current flows through the control winding 34, the core saturation effect caused by the control winding 34 is nil, and full power is delivered at the output teminals 22–24 of the magnetic amplifier 26, limited only by the self-saturation of the reactor 28 caused by the current flowing through the power windings 30 and 32.

Full power is also delivered to the electromagnetic chuck 10 anytime the control circuit 47 of the magnetic amplifier 26 is open, thus ensuring that, in the event of malfunction of the low voltage control circuit 47, full power is delivered to the electromagnetic chuck 10 such as to hold any workpiece, not shown, mounted on the chuck with full holding force, and thus preventing accidental or premature loosening of the workpiece from the chuck surface.

By actuating the rotary switch 76, such as to connect its terminal 82 to the common terminal 78 connected to the +B end of the low voltage DC source, the indicator light 88 is energized, thus indicating that workpiece "variable" holding force is available at the electromagnetic chuck 10. Workpiece variable holding mode is achieved via a line 94 connecting the rotary switch terminal 82 to the solenoid 66 of the relay switch 64. When the solenoid 66 is energized, the normally closed relay switch 64 opens, thus causing the DC current flowing through the magnetic amplifier control winding 34 to pass through the potentiometer 58. By adjusting the position of the slider of the potentiometer 58, the machine tool operator regulates the intensity of the current flowing through the control winding 34 of the magnetic amplifier 26 from full value to a minimum value. At full DC current flow through the control winding 34, the saturable reactor 28 of the magnetic amplifier 26 is fully saturated and negligible current, if any, is supplied across the magnetic amplifier output terminals 22–24. The magnetic amplifier output voltage and current increase as an inverse function of the current flowing through the control winding 34, such that, at the maximum resistance setting of the potentiometer 58, with practically no current flow through the magnetic amplifier control winding 34, full power is delivered at the magnetic amplifier output terminals 22–24 to the coil or coils 12 of the electromagnetic chuck 10.

By operating the rotary switch 76 such as to connect the rotary switch terminal 84 to the +B common terminal 78, the indicator light 90 is activated, thus indicating that the workpiece is held on the electromagnetic chuck 10 by "residual" magnetic force. As the series relay switch 60 in the control circuit 47 of the magnetic amplifier 26 is normally closed, and the shunt relay switch 64 of the series potentiometer 58 in the control circuit is also normally closed, full control DC current flows through the magnetic amplifier control winding 34, with the result that no power is delivered at the output terminals 22–24 of the magnetic amplifier 26. The workpiece held by the electromagnetic chuck 10 is consequently held only by the residual magnetic force caused by the residual magnetization of the workpiece and any residual magnetization of the cores of the electromagnetic chuck 10. If the residual magnetic force is not strong enough to effectively hold the workpiece on the surface of the electromagnetic chuck 10, the workpiece may be manually removed.

Figure 3:
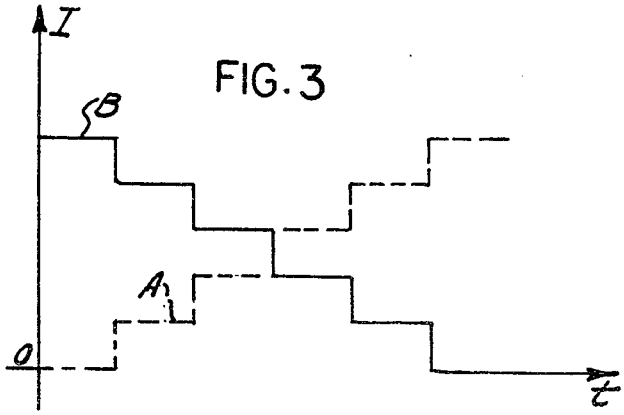
FIGS. 3 and 4 are waveform diagrams useful in illustrating the operation of the circuit diagram of FIG. 2.
Figure 4:
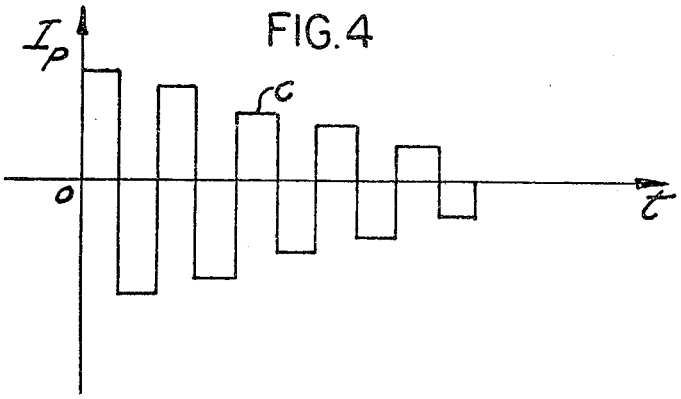

In order to operate the magnetic chuck 10 in the automatic de-magnetization mode, the machine tool operator operates the rotary switch 76 to the appropriate position placing the terminal 85 of the rotary switch in connection with the +B voltage terminal 78. The +B voltage is thus applied, through the "release" indicator light 98, via a line 100 across the solenoid 72 of the normally open relay switch 70, closing the relay switch 70 and placing the automatic de-magnetization unit 68 in the DC control circuit 47 of the magnetic amplifier control winding 34. The line 100 being also connected to the solenoid 62 of the normally closed relay switch 60, the solenoid 62 is simultaneously energized, thus causing the relay switch 60 to open for disconnecting the circuit branch comprising the potentiometer 58 from the magnetic amplifier DC control circuit 47. Simultaneously therewith, the line 100 applies the +B voltage to an input 102 of the automatic de-magnetization unit 68, such as to enable the unit for starting the automatic de-magnetization sequence. The workpiece automatic de-magnetization unit 68 automatically increases the DC current flowing through the control winding 34 of the saturable reactor 28 of the magnetic amplifier 26 from a zero value to a maximum value, by specific steps, as illustrated at FIG. 3 at ideal curve A, with the result that the corresponding current flow in the power windings 30 and 32 of the saturable reactor 28 is progressively decreased by consecutive steps, represented by ideal curve B, as a function of time. Simultaneously, the workpiece automatic de-magnetization unit 68 supplies at an output 104 through a line 106 a series of timed pulses at twice the frequency of the step variation rate of the current flow through the control circuit to actuate the solenoid 20 of the reversing switch 18, such that the coil, or coils, 12 of the magnetic chuck 10 is supplied with alternating DC pulses of gradually decreasing amplitude, as illustrated at C at FIG. 4, as a function of time.

The workpiece automatic de-magnetization unit 68 may take any appropriate circuit form, capable of providing a DC current increasing over a finite adjustable period of time, from a fraction of a second to two or three seconds for example, applied across the control winding 34 of the saturable reactor 28 of the magnetic amplifier 26, or a DC current increasing by steps or increments from a zero value to the maximum value required for full saturation of the cores of the magnetic reactor 28, while simultaneously energizing the control solenoid 20 of the reversing relay switch 18. The circuit of the workpiece automatic de-magnetization unit 68 may consist exclusively of electromagnetic devices, such as a plurality of relays disconnecting from the control circuit 47, in sequence, each of a plurality of voltage dropping resistors or current limiting resistors, or it may consist of an appropriate logic integrated circuit and electrical elements.

Figure 2:
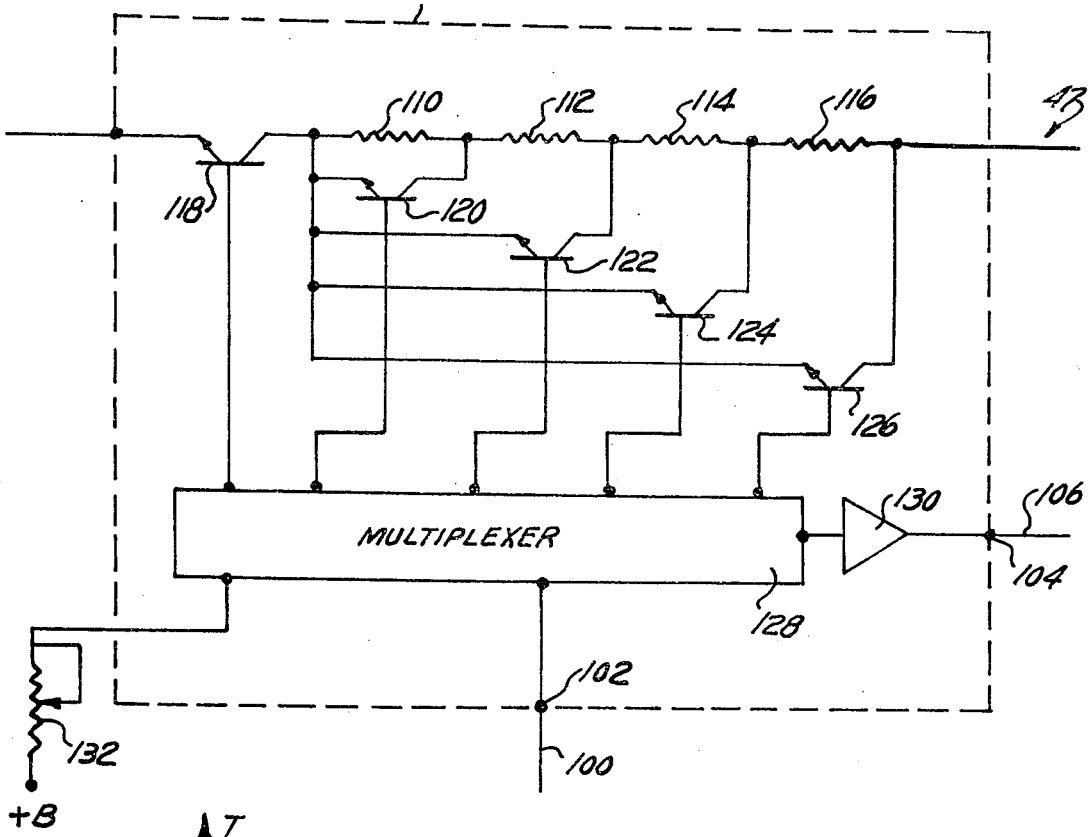
FIG. 2 is a simplified circuit diagram of a portion thereof.

An example of such a circuit is illustrated at FIG. 2 wherein four resistors 110, 112, 114 and 116 are shown connected in the magnetic amplifier control circuit in series with a switch in the form of a transistor 118. The emitter collector circuit of a transistor 120 shunts the resistor 110, the emitter collector circuit of a transistor 122 shunts the resistors 110 and 112, the emitter collector circuit of a transistor 124 shunts the resistors 110, 112 and 114, and a fourth transistor 126 is connected such that its emitter collector circuit shunts the full string of resistors 110–116. All the transistors are normally biased to a non-conductive state. A multiplexer 128 has each of a plurality of outputs connected to the base of each of the transistors 118–126. When a signal, such as the +B voltage through the line 100, is applied through the terminal 102 to an input of the multiplexer 128, voltage levels are caused to change sequentially at each of the outputs of the multiplexer. The voltage level for the multiplexer output applied to the base of the transistor 118 biases the transistor 118 to its conductive state and a limited current flows through the string of resistors 110 through 116, corresponding to the first step of the current flow curve A of FIG. 3. When the voltage level at the output of the multiplexer 128 connected to the base of the transistor 120 changes, the transistor 120 is biased to its conductive state and therefore shunts the resistor 110, with the result that the current flow through the string of resistors 112, 114 and 116 is increased, corresponding to the second step of curve A of FIG. 3. Subsequently, and in sequence, voltage level changes at the remaining outputs of the multiplexer 128 biases the transistors 122, 124 and 126, sequentially, to their conductance state, such as to shunt sequentially resistors 110 and 112, resistors 110, 112 and 114, and the whole string of resistors 110 through 116, thus incrementally increasing the current flowing through the magnetic amplifier control circuit 47 to full current flow. Consequently, the current through the control circuit 47 is increased by consecutive steps from a minimum value, cut-off, to a maximum value when the whole string of resistors 110 through 116 is shunted. In time synchronization with the operation of the transistors 120–126 from a non-conductive to a conductive state, a signal at twice the frequency of transistor bias changes appears at another output of the multiplexer 128. The signal, after amplification by an amplifier 130, is applied through the automatic de-magnetization unit 68 to the output 104 and the line 106 to the actuating solenoid 20 of the reversing relay switch 18, FIG. 1, at the input of the electromagnetic chuck 10. The reversal of the incrementally decreasing current flow through the coil or coils 12 of the electromagnetic chuck 10 causes a series of alternating pulse, as ideally represented by curve C of FIG. 4, to flow through the coil or coils 12 of the electromagnetic chuck 10, thus progressively de-magnetizing the electromagnetic chuck cores and the workpiece on the chuck surface.

The time basis for the operation of the multiplexer 128 is obtained from a potentiometer 132, installed on the electromagnetic chuck control panel and accessible to the machine tool operator. The adjustable voltage across the potentiometer 132 widens or narrows the periods of the voltage increase steps in the magnetic amplifier control circuit 47.

It will be readily appreciated by those skilled in the art that digital units other than multiplexers, such as monostable multivibrators operating up/down counters or flip-flops, for example, may be used in conjunction with appropriate semiconductor switches for progressively shunting a string or series of dropping resistors in the magnetic amplifier control circuit, and that any or all of the relay switches in the circuit of FIG. 1, which have been represented by electro-mechanical switches, may be in the form of semi-conductor switches. It will be further appreciated by those skilled in the art that, if so desired, an auxiliary manual de-magnetization mode may be provided in the arrangement of the invention by simply connecting via a line 134, shown in dashed line at FIG. 1, the actuating solenoid 20 of the reversing relay switch 18 to the +B voltage source through a normally open switch 136, manually closed for momentarily reversing the current flow through the magnetic chuck coil 12, while manually increasing the current flow through the control circuit 47 from a minimum to a maximum by way of the potentiometer 58. Such a manual de-magnetization mode becomes convenient in the event of malfunction of the automatic de-magnetization unit 68.

Having thus described the present invention by way of a practical example of an embodiment thereof well designed to accomplish the objects of the invention, what is claimed as new is as follows:

1. A controllable DC power supply for an electromagnetic chuck comprising a magnetic amplifier comprising a saturable reactor having a pair of power windings and a control winding, means for rectifying the electrical current supplied by said power windings, means for connecting said rectified current to said electromagnetic chuck, means for applying a DC current across said control winding for saturating said saturable reactor as a function of the current flow through said control winding whereby the current flowing through said electromagnetic chuck is an inverse function of the current flowing in said control winding, and means for controllably and momentarily reversing current flow through said electromagnetic chuck.

2. The controllable DC power supply of claim 1 further comprising means for controllably varying the DC current flow through said control winding.

3. The controllable DC power supply of claim 1 further comprising means for shutting off current flow through said control winding for providing full power at the output of said power windings.

4. The controllable DC power supply of claim 1 further comprising means for full current flow through said control winding for fully saturating said saturable reactor for cutting off current flow through said power windings.

5. The controllable DC power supply of claim 1 further comprising means for applying to said electromagnetic chuck an alternating current progressively variable from a maximum to zero for de-magnetizing a workpiece disposed on said electromagnetic chuck.

6. The controllable DC power supply of claim 5 wherein said means for supplying an alternating current of progressively decreasing amplitude to said electromagnetic chuck comprises means for progressively increasing the current flow through said control winding while simultaneously reversing periodically the current flow to said electromagnetic chuck.

7. The controllable DC power supply of claim 2 further comprising means for shutting off current flow through said control winding for providing full power at the output of said power windings.

8. The controllable DC power supply of claim 2 further comprising means for full current flow through said control winding for fully saturating said saturable reactor for cutting off current flow through said power windings.

9. The controllable DC power supply of claim 2 further comprising means for applying to said electromagnetic chuck an alternating current progressively variable from a maximum to zero for de-magnetizing a workpiece disposed on said electromagnetic chuck.

10. The controllable DC power supply of claim 5 wherein said means for supplying an alternating current of progressively decreasing amplitude to said electromagnetic chuck comprises means for progressively increasing the current flow through said control winding while simultaneously reversing periodically the current flow to said electromagnetic chuck.

11. The controllable DC power supply of claim 3 further comprising means for full current flow through said control winding for fully saturating said saturable reactor for cutting off current flow through said power windings.

12. The controllable DC power supply of claim 3 further comprising means for applying to said electromagnetic chuck an alternating current progressively variable from a maximum to zero for de-magnetizing a workpiece disposed on said electromagnetic chuck.

13. The controllable DC power supply of claim 12 wherein said means for supplying an alternating current of progressively decreasing amplitude to said electromagnetic chuck comprises means for progressively increasing the current flow through said control winding while simultaneously reversing periodically the current flow to said electromagnetic chuck.

14. The controllable DC power supply of claim 4 further comprising means for applying to said electromagnetic chuck an alternating current progressively variable from a maximum to zero for de-magnetizing a workpiece disposed on said electromagnetic chuck.

15. The controllable DC power supply of claim 14 wherein said means for supplying an alternating current of progressively decreasing amplitude to said electromagnetic chuck comprises means for progressively increasing the current flow through said control winding while simultaneously reversing periodically the current flow to said electromagnetic chuck.

* * * * *